United States Patent [19]

Mixon, Jr.

[11] 4,384,753

[45] May 24, 1983

[54] ELECTRICAL EDGE CONNECTOR

[75] Inventor: James L. Mixon, Jr., Harrisburg, Pa.

[73] Assignee: AMP Incorporated, Harrisburg, Pa.

[21] Appl. No.: 277,528

[22] Filed: Jun. 26, 1981

[51] Int. Cl.[3] ..... H01R 4/66

[52] U.S. Cl. ..... 339/14 R; 339/95 R; 339/263 L; 339/266 G

[58] Field of Search ..... 339/14 R, 14 L, 95 R, 339/263 L, 266 G; 174/6

[56] References Cited

U.S. PATENT DOCUMENTS

| | | | |
|---|---|---|---|
| 1,399,456 | 12/1921 | Barry | 248/72 |
| 2,385,209 | 9/1945 | Joyce | 24/259 |
| 2,715,714 | 9/1955 | Pavlinetz | 339/95 R X |

FOREIGN PATENT DOCUMENTS

| | | | |
|---|---|---|---|
| 2811241 | 7/1979 | Fed. Rep. of Germany | 339/14 R |
| 2811308 | 9/1979 | Fed. Rep. of Germany | 339/95 R |
| 1193788 | 5/1959 | France | 339/14 L |

*Primary Examiner*—Eugene F. Desmond
*Attorney, Agent, or Firm*—Allan B. Osborne

[57] ABSTRACT

An electrical connector comprising two inner members movably positioned between the legs of a U-shaped outer member with the facing surfaces of the inner members and legs having cooperating, passage-forming grooves in which conductors may be positioned. Upon driving the connector onto an edge of a metallic framework, the inner members are driven outwardly against the legs to crimp conductors which may be positioned in the passages. Teeth on the inwardly facing surfaces of the inner members are adapted to grip the edge to hold the connector thereon.

4 Claims, 5 Drawing Figures

Fig. 3
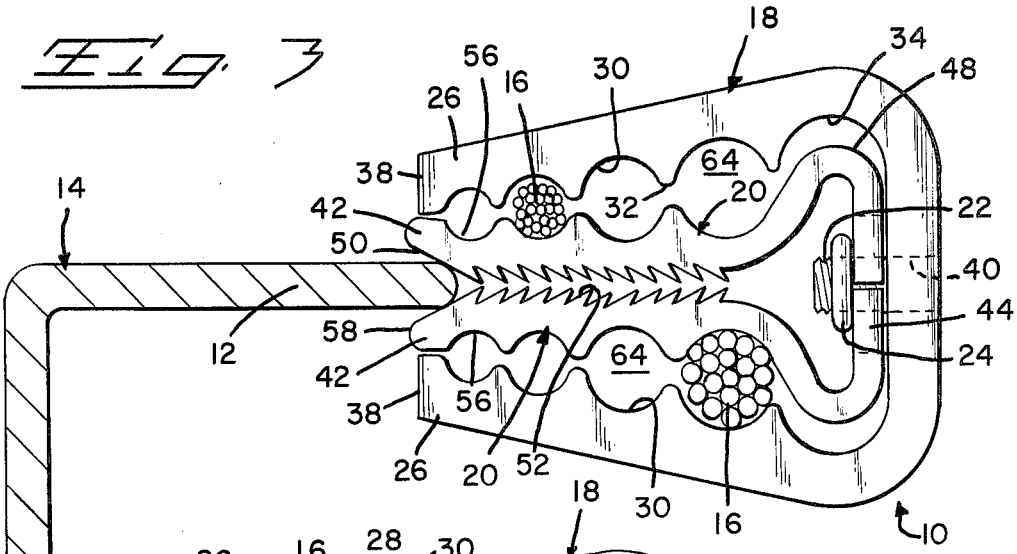
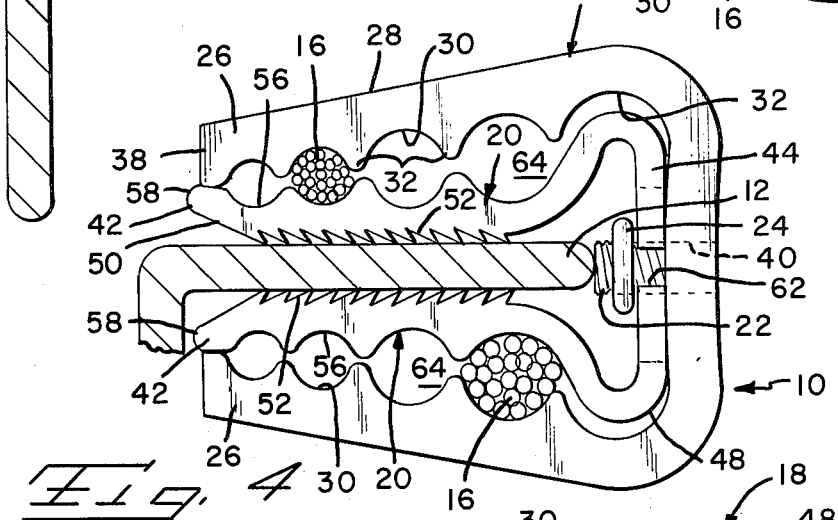
Fig. 4
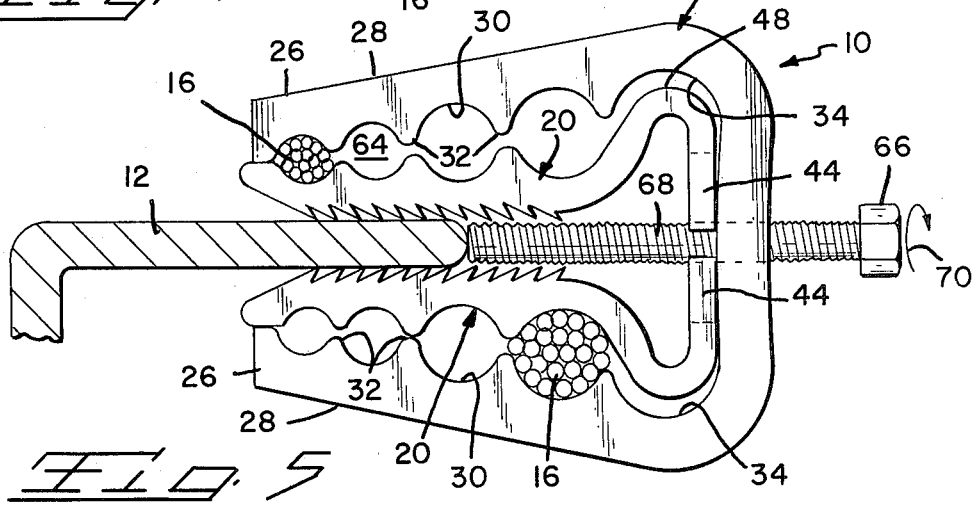
Fig. 5

ELECTRICAL EDGE CONNECTOR

This invention relates to connectors for electrically connecting one or more ground conductors to structural steel, aluminum and other metallic frameworks such as towers, large equipment supports and cable trays.

It is known in the electrical and building industries to electrically connect ground conductors to metallic framework by bolting lugs to such framework with the lugs having means thereon in which the conductors are crimped or otherwise fastened. Such procedures are time consuming and labor intensive, not only because of the required bolting but because the surface to which the lug is attached must have been thoroughly cleaned by wire bushing and suitable holes drilled.

It would be desirable to improve the way such grounding conductors could be electrically connected to metallic frameworks quickly and with a high degree of electrical integrity. The present invention is directed to the achievement of an electrical edge connector that can easily and rapidly connect grounding conductors to metallic frameworks.

According to the present invention, an electrical connector intended for being mounted on an edge of a metallic framework and for grounding conductors thereto has a pair of inner members movably mounted within a U-shaped outer member. The inside surfaces of the inner members have teeth and the outer surfaces have arcuate shaped grooves. The inside surfaces of the legs on the outer member also having complementary arcuate shaped grooves. The inner members are movably mounted in between the legs on the outer member so that the grooves cooperate to form circular, conductor-receiving passages. With conductors positioned in the passages, the connector is driven onto an edge of a metallic framework, the edge being received between the two inner members with the teeth engaging the surfaces of the edge to retain the connector thereon. The intervening edge forces the inner members outwardly against the legs so that the conductors in the passages are secured therein by the crimping action.

An embodiment of the invention will now be described by way of example with reference to the accompanying drawings in which:

FIGS. 3 and 4 are side views showing the connector of FIG. 1 before and after being mounted on an edge of a metallic framework; and FIG. 5 is a view of an alternative embodiment showing a method for removing the electrical connector from an edge of a framework.

Figure 1:
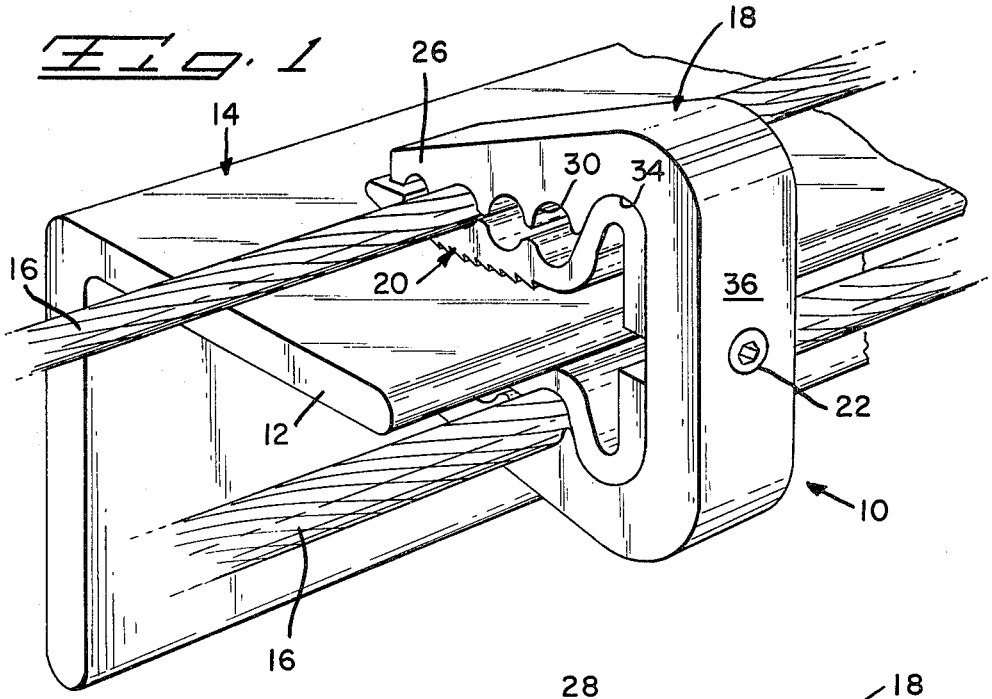
FIG. 1 is a perspective view of the electrical connector of the present invention showing it mounted on an edge of a metallic framework and grounding thereto two conductors.

In FIG. 1, connector 10 of the present invention is shown positioned in a secured manner to an edge 12 of metallic framework 14. Two conductors 16 of different sizes are electrically grounded to the framework by means of connector 10 in a manner to be discussed below.

Figure 2:
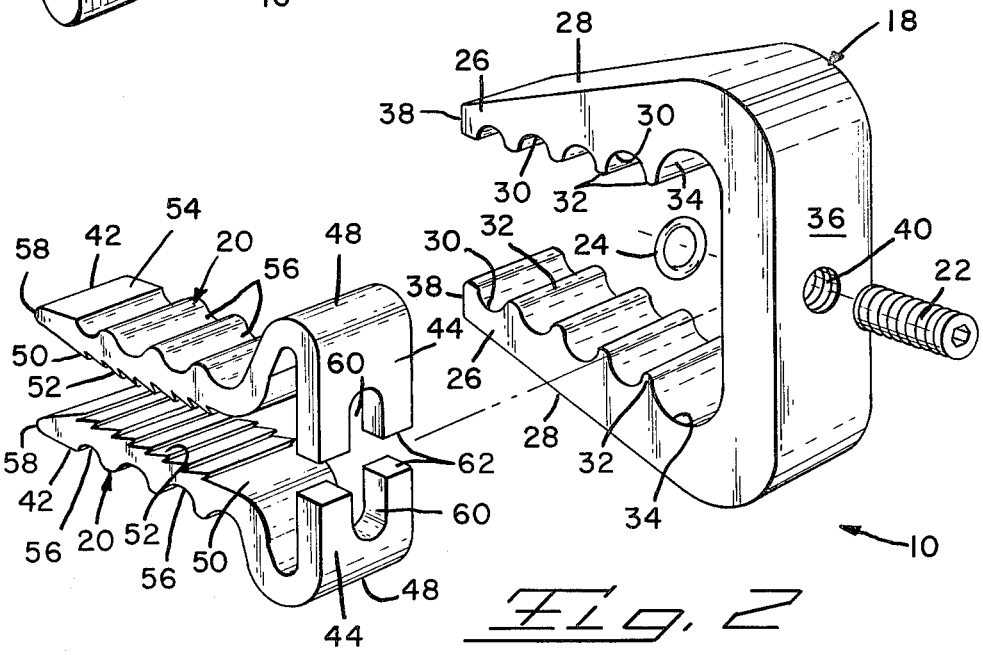
FIG. 2 is a perspective view of the connector of FIG. 1 showing the several parts thereof in exploded fashion.

FIG. 2 shows in exploded fashion the several components of connector 10. They are: a U-shaped outer member 18, two identically shaped inner members 20, a setscrew 22 and O-ring 24.

With regard to the outer member 18, its two legs 26 have smooth outer surfaces 28 and a plurality of arcuate shaped, conductor-receiving grooves 30 spaced along the inner surfaces 32. Additionally, a substantially larger, nose-receiving groove 34 is provided on each inside surface adjacent leg connecting bight 36 of the outer member. The conductor-receiving grooves 30 range in size with the smallest of the series being adjacent free end 38 of each leg and the largest being adjacent nose-receiving groove 34.

Bight 36 contains a centrally located, threaded bore 40 which receives setscrew 22. The bore could be smooth to alternatively receive a split roll pin (not shown).

The two inner members 20 each have an elongated finger 42 and a flange 44 which lies in a plane perpendicular to the finger. An obliquely-extending strap 46 connects the finger and flange together and further provides a rounded nose 48 at its connection with the flange. The strap extending obliquely from the finger permits a longer flange.

The inside surface 50 of each finger is provided with a plurality of saw-tooth teeth 52 with the tips thereof facing flange 44 obliquely.

The outside surface 54 of each finger has a plurality of conductor-receiving, arcuate grooves 56 extending along the surface from free end 58 to strap 46. These grooves correspond in size and number with grooves 30 on the inside surfaces of legs 26 on outer member 18.

A notch 60 is provided in the free end 62 of each flange 44.

Pin 22 is a conventional, threaded setscrew. O-ring 24 is also a conventional item, preferably made from neoprene rubber.

FIG. 3 is a side view showing how the connector is assembled as well as the initial step in being attached to edge 12 of framework 14. The two inner members 20 are placed within outer member 18 with grooves 56 on fingers 42 facing grooves 30 on legs 26. Each pair of facing grooves provide a circular passage 64 extending through connector 10.

With the inner members so positioned, teeth 52 on each inside surface 50 of fingers 42 face inwardly towards each other and noses 48 are in alignment with nose-receiving grooves 34 on the inside surfaces of legs 26.

The inner members are held in the FIG. 3 position by setscrew 22 and O-ring 24. The setscrew is threaded into bore 40 to extend through notches 60 in flanges 44. The O-ring is forcefully positioned on the setscrew behind the flanges to thereby retain the inner members in position within outer member 18. The inner members are free to slide outwardly towards legs 26 but cannot fall out or be pushed out of outer member 18.

The use of connector 10 varies slightly depending on whether conductors 16 are continuous or have an end readily available. In the latter case, the conductor ends are threaded through the appropriate passages 64 after which the connector 10 is placed against edge 12 as shown in FIG. 3; i.e., the edge is located between free ends 58 of inner members 20. Thereafter the connector is driven onto the edge as shown in FIG. 4. The intervening edge forces the inner members 20 out towards legs 26 on the outer member. In so doing, the diameter of passages 64 are reduced, crimping conductors 16 therein. Teeth 52 engage the sides of edge 12 to prevent the inadvertant withdrawal of connector 10 therefrom. The noses 48 are received in grooves 34.

An alternative method is used where conductor ends are not conveniently available. Setscrew 22 and O-ring 24 are taken out and inner members 20 removed from outer member 18. The outer member is placed around the conductors to be grounded. Holding the two inner members together with the teeth on each finger meeting, the conductors are laid across and held in appropriate grooves 56. Outer member 18 is slid over the two inner members to the aligned position illustrated in the drawings, setscrew 22 is replaced and the connector driven onto edge 12 to make the termination as described above.

Connector 10 is secured to edge 12 by being driven thereonto by means of a hammer or like tool. FIG. 5 illustrates a method to remove the connector using bolt 66 which is threaded into bore 40. The bolt has an elongated shaft 68 which extends down between inner members 20 and contacts edge 12. The connector is removed from the edge by rotating the bolt in the direction of arrow 70. This causes the connector to be withdrawn from the edge.

Both outer member 18 and inner members 20 are preferably made from the same or similar material as the framework or buss to which it will be applied. For example, in the case of aluminum framework, the connector would preferably be made from aluminum alloy.

The present invention may be subject to many modifications and changes without departing from the spirit or essential characteristics thereof. The present embodiment is therefore intended in all respects as being illustrative and not restrictive of the scope of the invention.

I claim:

1. An electrical connector mountable on an edge of a metallic framework for grounding electrical cables thereto, the connector being characterized by having:

a. a pair of inner members with each having an elongated finger, with the finger having a plurality of grooves spaced along one surface;

b. a U-shaped outer member with each leg thereon having a plurality of grooves spaced along the inside surfaces; and c. means for movably mounting the inner members in between the legs on the outer member with the grooves facing and cooperating with the grooves on the legs to form passages so that upon driving the connector onto an edge with the edge in between the two inner members, the inner members are forced outwardly towards the legs whereby conductors which may be positioned in the passages are crimped therein.

2. The electrical connector of claim 1 wherein the inner members include a flange extending perpendicular to the finger and having a notch in the free end and the means for movably mounting the inner members within the U-shaped outer member includes first means positioned in the bight of the outer member and extending through the notches and second means movably mounted on the first means behind the flanges.

3. The electrical connector of claim 2 wherein the first means includes a setscrew and the second means include an O-ring.

4. The electrical connector of claim 1, 2 or 3 further including teeth on the surface opposite the grooved surface on the inner members, said teeth being adapted to grip the edge of the framework to hold the connector thereon.

* * * * *